US006913502B2

(12) United States Patent
Park et al.

(10) Patent No.: US 6,913,502 B2
(45) Date of Patent: Jul. 5, 2005

(54) METHOD OF FABRICATING PLASMA DISPLAY PANEL

(75) Inventors: Deuk-il Park, Cheonan (KR); Moo-sung Kim, Cheonan (KR); Choong-yop Rhew, Cheonan (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 132 days.

(21) Appl. No.: 10/465,622

(22) Filed: Jun. 20, 2003

(65) Prior Publication Data

US 2003/0214237 A1 Nov. 20, 2003

Related U.S. Application Data

(62) Division of application No. 09/564,552, filed on May 4, 2000, now Pat. No. 6,590,332.

(30) Foreign Application Priority Data

Aug. 6, 1999 (KR) ..... 1999-32305

(51) Int. Cl.[7] ..... H01J 9/00; H01J 9/40; H01J 9/38

(52) U.S. Cl. ..... 445/25; 445/24

(58) Field of Search ..... 445/24, 25

(56) References Cited

U.S. PATENT DOCUMENTS 3,778,126 A 12/1973 Wilson
3,778,127 A 12/1973 Langston, Jr. et al.
3,879,629 A 4/1975 Durand
4,841,194 A 6/1989 Kishino et al.
5,207,607 A 5/1993 Nagano et al.
5,670,843 A 9/1997 Matsuura
5,754,003 A 5/1998 Murai et al.
5,808,719 A * 9/1998 Fujiwara et al. ..... 349/157
5,867,236 A * 2/1999 Babuka et al. ..... 349/153
5,886,467 A 3/1999 Kimura
6,078,379 A * 6/2000 Nagae et al. ..... 349/155
6,114,804 A 9/2000 Kawase et al.
6,144,425 A * 11/2000 Kawabata et al. ..... 349/155
6,169,358 B1 1/2001 Jones et al.

* cited by examiner

*Primary Examiner*—Mariceli Santiago
(74) *Attorney, Agent, or Firm*—Leydig, Voit & Mayer, Ltd.

(57) ABSTRACT

A method for fabricating a plasma display panel includes preparing from front substrates an assembly for forming a display part for displaying an image, and preparing from rear substrates a rear substrate assembly. Only the outer edge of the front and rear substrate assemblies are coated with a first frit. An upper glass for mounting on the top of the front substrate assembly, and a lower glass for mounting on the bottom of the rear substrate assembly. Only the edges of the upper and lower glasses are coated with a second frit glass. An outer edge of the front and rear substrate assemblies are coated with a third frit glass and the upper and lower glasses are sealed to the front and rear substrate assemblies and the front and rear assemblies are sealed together and evacuated. A discharge gas is injected between the front and rear assemblies.

3 Claims, 4 Drawing Sheets

METHOD OF FABRICATING PLASMA DISPLAY PANEL

This application is a divisional of application Ser. No. 09/564,552, filed May 4, 2000, now U.S. Pat. No. 6,590,332, issued Jul. 8, 2003.

BACKGROUND OF THE INVENTION

1. Field of the Invention

The present invention relates to plasma display panel, and more particularly, to a plasma display panel whose structure is improved to realize a large image and a method for fabricating the same.

2. Description of the Related Art

In a usual plasma display panel, discharge gas is injected between a pair of substrates facing each other. Ultraviolet rays which are generated during discharge excite phosphors, thereby displaying an image. Plasma display panels are classified into a direct current type and an alternating current type according to the type of discharge and classified into a counter discharge type and a surface discharge type according to the structure of electrodes.

FIG. 1 shows a conventional plasma display panel. Referring to FIG. 1, a panel 10 includes a front substrate 11 and a rear substrate 12. Common electrodes 13 and scanning electrodes 14 alternate on the bottom surface of the front substrate 11 in a striped pattern. Bus electrodes 15 on the bottom surfaces of the common and scanning electrodes 13 and 14 reduce the line resistance of the electrodes 13 and 14. Each bus electrode 15 is a metal material narrower than the common or scanning electrode 13 or 14. A first dielectric layer 16 is on the bottom surface of the front substrate 11 such that the common and scanning electrodes 13 and 14 and the bus electrodes 15 are embedded in the first dielectric layer 16. A protective layer 17, for example, a MgO layer, is on the bottom surface of the first dielectric layer 16.

Address electrodes 18 on the rear substrate 12 are orthogonal to the common and scanning electrodes 13 and 14 in a striped pattern. The address electrodes 18 are embedded in a second dielectric layer 19. A plurality of partition walls 100 on the second dielectric layer 19 are spaced apart by a predetermined distance. Red, green, and blue light-producing phosphor layers 110 are located between the partition walls 100. A plurality of panels 10 are assembled to implement a large image.

FIG. 2 shows a conventional large plasma display panel. Referring to FIG. 2, the large plasma display panel includes a first front substrate 21, a second front substrate 22, a third front substrate 23, and a fourth front substrate 24. First, second, third, and fourth rear substrates 210, 220, 230, and 240 the first, second, third, and fourth front substrates 21, 22, 23, and 24, respectively.

The first, second, third and fourth front substrates 21, 22, 23 and 24 are connected to one another along their edges to thereby form a single large front substrate 20. The first, second, third and fourth rear substrates 210, 220, 230 and 240 are connected to one another along their edges to thereby form a single large rear substrate 200.

To keep the large plasma display panel in a vacuum state, a first frit glass 25 is provided at the portion at which the first, second, third and fourth front substrates 21, 22, 23 and 24 come in contact with one another, and a second frit glass 250 is provided at the portion at which the first, second, third and fourth rear substrates 210, 220, 230 and 240 come in contact with one another.

In the conventional large plasma display panel, a phenomenon in which an image is minutely sectioned occurs due to the first fit glass 25 and the second flit glass 250, thereby deteriorating picture quality. To overcome this phenomenon, the width of each of the first flit glass 25 and the second flit glass 250 where the substrates come in contact must be minimized. However, the first flit glass 25 and the second flit glass 250 are essential to keeping the vacuum airtightness of the plasma display panel. Therefore, the phenomenon of an image being sectioned is an unavoidable problem in the conventional large plasma display panel.

SUMMARY OF THE INVENTION

To solve the above problem, an object of the present invention is to provide a plasma display panel whose structure is improved to remove the phenomenon of an image being sectioned when a single large plasma display panel is fabricated by assembling a plurality of panels and a method for fabricating the plasma display panel.

To achieve the above object, in one aspect, the present invention provides a plasma display panel includes a plurality of front substrates for forming a display part for displaying an image, a plurality of rear substrates provided to be sealed to corresponding front substrates, a first frit glass with which the outer edge of the front and rear substrates are coated, an upper glass provided on the top of the plurality of front substrates, a lower glass which is provided on the bottom of the plurality of rear substrates and sealed to the upper glass, and a second frit glass with which the edge of the upper and lower glasses is coated.

In addition, the first frit glass is provided along the edge of the assembled plurality of front and rear substrates.

Further, the inner surface forming the display part in the plurality of front substrates and the inner surface of the plurality of rear substrates are not coated with the first frit glass.

Moreover, the lower glass is provided with a second evacuation hole at the same position as that of a first evacuation provided in the rear substrate.

In another aspect, the present invention provides a method for fabricating a plasma display panel, including the steps of preparing a plurality of front substrates for forming a display part for displaying an image and a plurality of rear substrates to be sealed to the corresponding front substrates; coating the edge of the plurality of front and rear substrates with a first frit glass; preparing an upper glass to be mounted on the top of the front substrates and a lower glass to be mounted on the bottom of the rear substrates and to face and to be sealed to the upper glass; coating the edge of the upper and lower glasses with a second frit glass; positioning the plurality of front and rear substrates between the upper and lower glasses and coating the outer side edge of the front and rear substrates with a third frit glass; sealing the front substrates to the rear substrates and sealing the upper glass to the lower glass; performing high temperature evacuation to remove impurities between the front and rear substrates; and injecting discharge gas between the front and rear substrates and removing an evacuation pipe.

In addition, in the step of coating the edge of the plurality of front and rear substrates with the first frit glass, the display part in the inner side of the front and rear substrates is not coated with the first frit glass, and the outer edge of the front and rear substrates is coated with the first frit glass.

Further, in the step of performing the high temperature evacuation, a second evacuation hole is formed in the lower glass such that the central axis of the second hole is the same as that of a first hole formed in the rear substrate. The evacuation is performed via the communicating first and second evacuation holes.

BRIEF DESCRIPTION OF THE DRAWINGS

The above object and advantage of the present invention will become more apparent by describing in detail a preferred embodiment thereof with reference to the attached drawings in which.

DETAILED DESCRIPTION OF THE INVENTION

Figure 1:
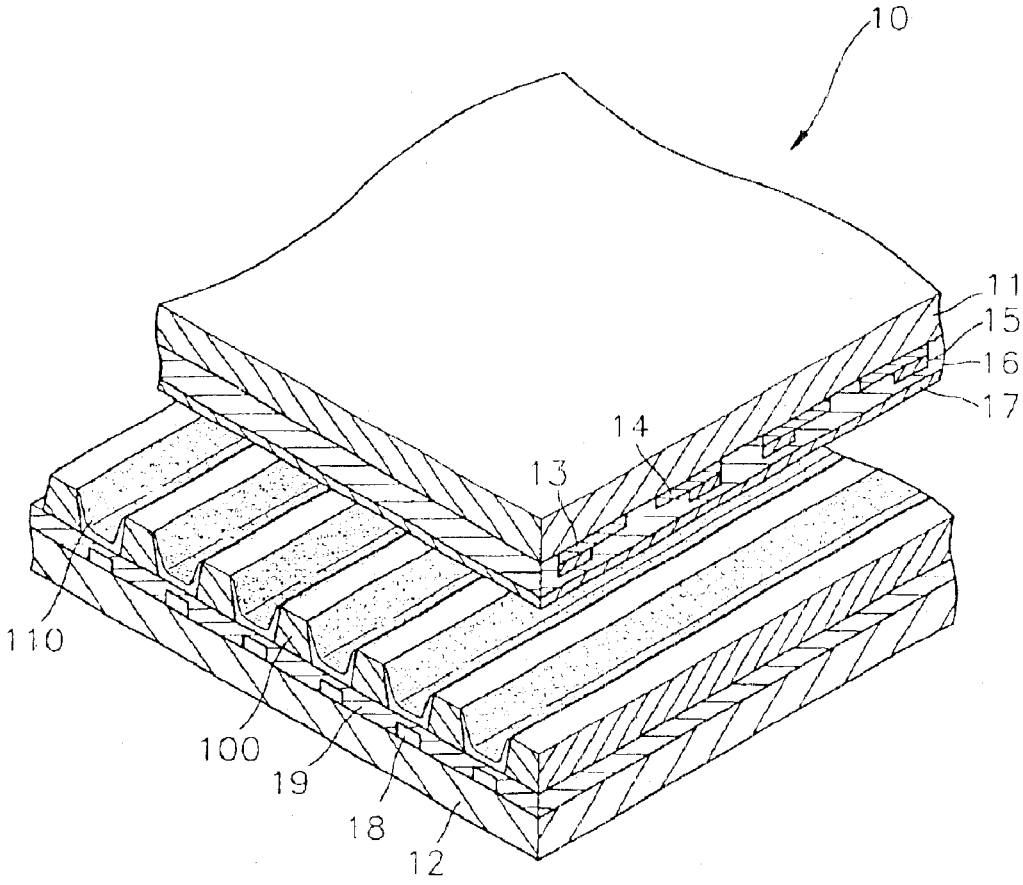
FIG. 1 PRIOR ART
FIG. 1 is a partially exploded, perspective view of a typical plasma display panel.
Figure 2:
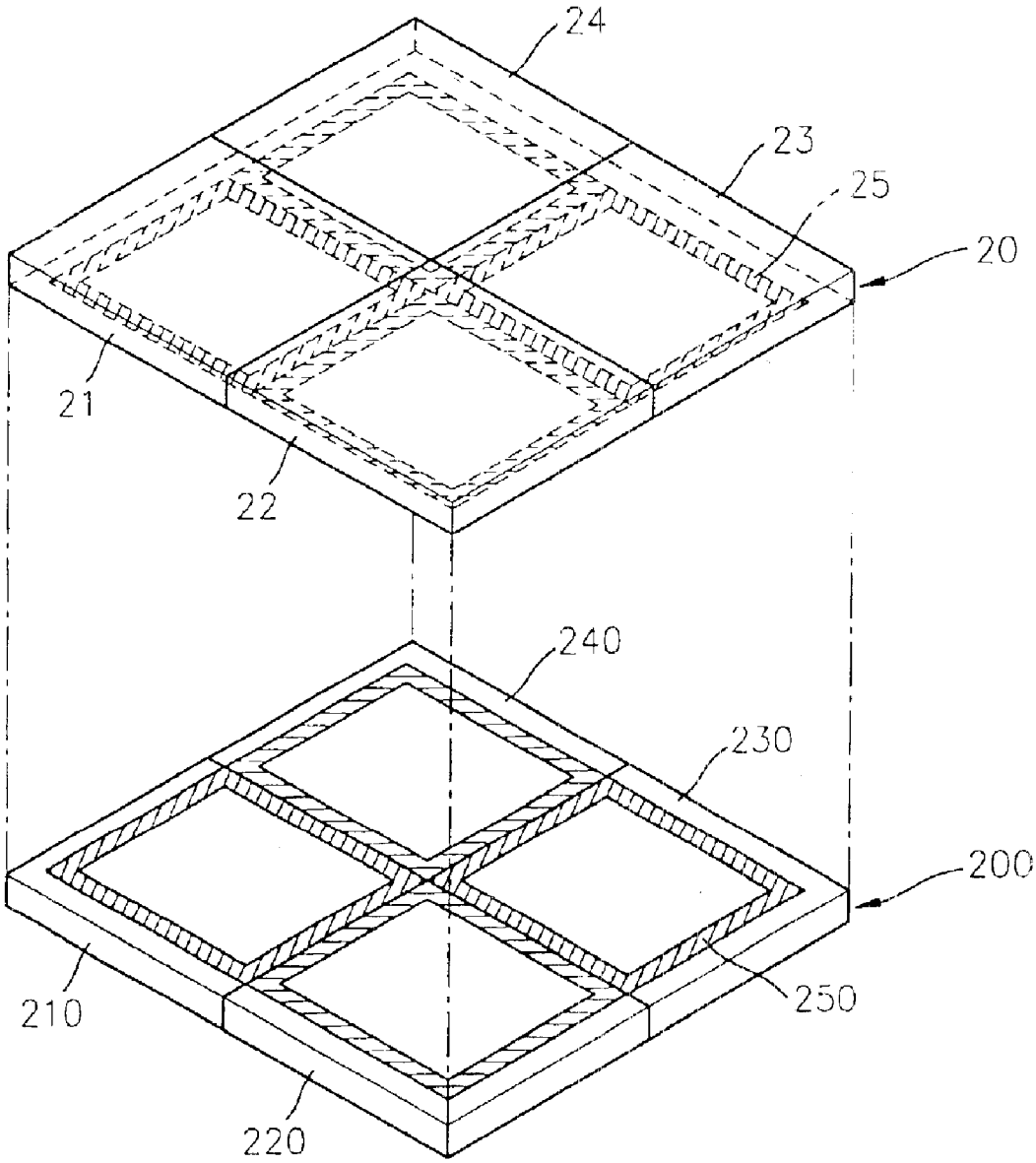
FIG. 2 PRIOR ART
FIG. 2 is an exploded perspective view of a conventional large plasma display panel.

Referring to FIG. 1, a plasma display panel 10 includes a front substrate 11 and a rear substrate 12. Common electrodes 13 and scanning electrodes 14 alternate on the bottom surface of the front substrate 11 in a striped pattern. Bus electrodes 15 may be formed on the bottom surfaces of the common and scanning electrodes 13 and 14, to reduce line resistance. Each bus electrode 15 is a metal material narrower than the common or scanning electrode 13 or 14. A first dielectric layer 16 on the bottom surface of the front substrate 11 embeds the common and scanning electrodes 13 and 14 and the bus electrodes 15. A protective layer 17, for example, a MgO layer, on the bottom surface of the first dielectric layer 16 protects the first dielectric layer 16.

Address electrodes 18 on the rear substrate 12 disposed to face the front substrate 11 are orthogonal to the common and scanning electrodes 13 and 14 in a striped pattern. The address electrodes 18 may be embedded in a second dielectric layer 19.

Partition walls 100 on the second dielectric layer 19 spaced apart by a predetermined distance to define discharge spaces and create cross-talk between electrodes. Red, greens and blue light-producing phosphor layers 110 are located between the partition walls 100. A plasma display panel for providing a large image according to the present invention is implemented by assembling a plurality of plasma display panels.

Figure 3:
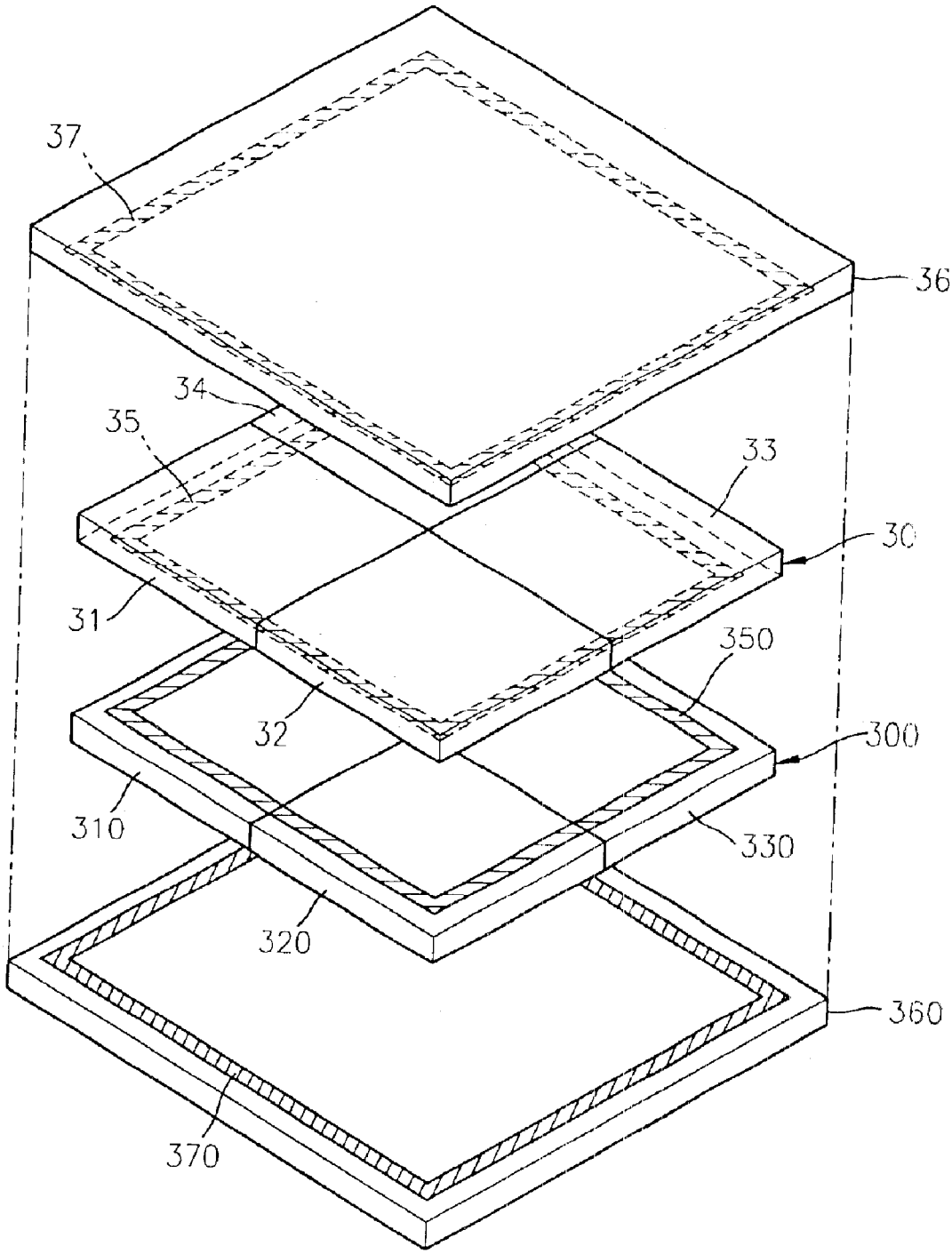
FIG. 3 is an exploded perspective view of a large plasma display panel according to the present invention.
Figure 4:
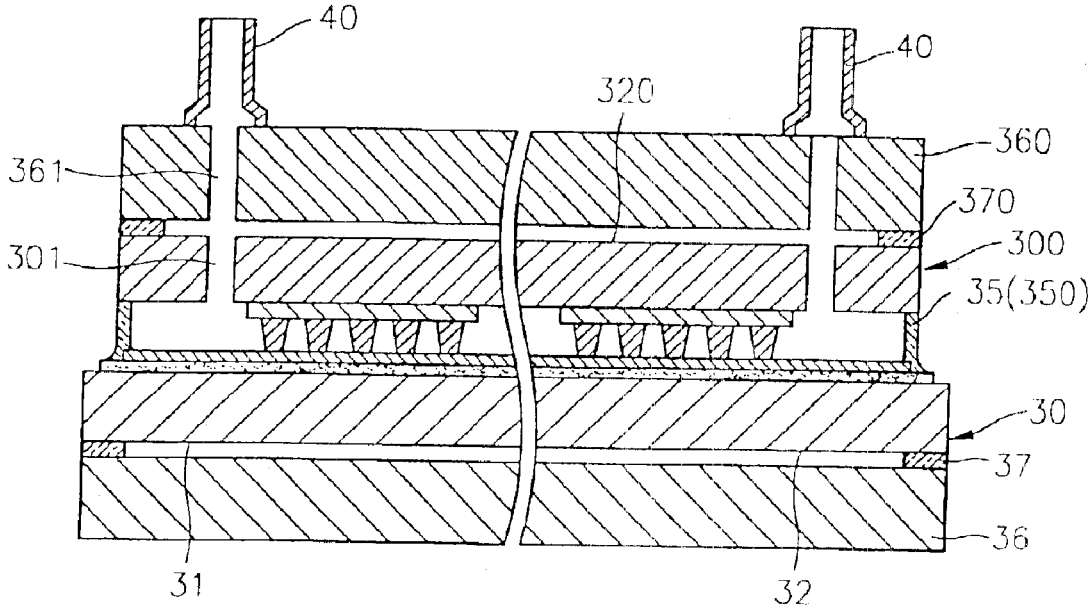
FIG. 4 is a sectional view of the assembled plasma display panel of FIG. 3.

FIG. 3 is an exploded view of a large plasma display panel for providing a large image. FIG. 4 shows the assembled large plasma display panel of FIG. 3.

Referring to FIGS. 3 and 4, the large plasma display panel according to the present invention includes a first front substrate 31, a second front substrate 32, a third front substrate 33 and a fourth front substrate 34. A first rear substrate 310, a second rear substrate 320, a third rear substrate 330 and a fourth rear substrate (not shown) for forming an image are provided to face the first, second, third and fourth front substrates 31, 32, 33 and 34, respectively.

The first, second, third and fourth front substrates 31, 32, 33 and 34 come in contact with one another to thereby form a single large front substrate 30. The first, second, third and fourth rear substrates 310, 320 and 330 come in contact with one another to thereby form a single large rear substrate 300.

A first frit glass 35 is provided along the edge of the large front substrate 30. A second frit glass 350 is provided along the edge of the large rear substrate 300.

The inner side of the front substrates 31, 32, 33 and 34, which corresponds to a display part for displaying a large image, is not coated with the first frit glass 35. Only the outer edge of the front substrates 31, 32, 33 and 34 is coated with the first frit glass 35. Similarly, the inner side of the rear substrates 310, 320 and 330 is not coated with the second frit glass 350. Only the outer edge of the rear substrates 310, 320 and 330 is coated with the second frit glass 350.

An upper glass 36 is mounted on the large front substrate 30. A lower glass 360 is mounted on the bottom of the large rear substrate 300. One side of the upper glass 36 is coated with a third frit glass 37, and one side of the lower glass 360 is coated with a fourth frit glass 370.

As shown in FIG. 4, a first evacuation hole 301 is located in the rear substrate 300. A second evacuation hole 361 communicating with the first evacuation hole 301 is located in the lower glass 360. The second evacuation hole 361 in the lower glass 360 is at the same position as that of the first evacuation hole 301 in the rear substrate 300.

The following description concerns a method for fabricating a large plasma display panel having the above structure according to the present invention. First, a plurality of front substrates 31, 32, 33 and 34 are prepared to form a display part for displaying an image. A plurality of rear substrates 310, 320 and 330 are prepared to face and be sealed to the front substrates 31, 32, 33 and 34.

Next, the outer edge of the front substrates 31, 32, 33 and 34 and the outer edge of the rear substrates 310, 320 and 330 are coated with the first frit glass 35 and the second frit glass 350, respectively.

Subsequently, the upper glass 36 is prepared to be mounted on the top of the front substrate 31, 32, 33 and 34. The lower glass 360 is prepared to be mounted on the bottom of the rear substrates 310, 320 and 330 and to face and to be sealed to the upper glass 36.

The edge of the upper glass 36 and the edge of the lower glass 360 are coated with the third frit glass 37 and the fourth frit glass 370. Thereafter, the plurality of front substrates 31, 32, 33 and 34 and the plurality of rear substrates 310, 320 and 330 are positioned between the upper glass 36 and the lower glass 360, and the outer side edge of the front substrates 31, 32 and 33 and rear substrates 310, 320 and 330 is coated with fifth frit glass (not shown).

Next, the front substrates 31, 32, 33 and 34 are sealed to the rear substrates 310, 320 and 330. Then, the upper glass 36 is sealed to the lower glass 360.

After sealing the panel, the inside of the panel is evacuated to a vacuum state at a high temperature to remove impurities including moisture. After a high vacuum state is achieved, a barium or zirconium getter is heated and activated by, for example, high frequency induction heating to adsorb gas other than desired gas in the panel.

Next a discharge gas containing xenon as a chief element is injected between the front substrates 31, 32, 33, and 34 and the rear substrates 310, 320, and 330 via an evacuation pipe 40. Thereafter, the evacuation pipe 40 is removed.

Subsequently, a predetermined voltage is applied to the panel to produce an aging discharge, and then the getter is cut out, thereby completing the plasma display panel according to the present invention.

As described above, the plasma display panel of the present invention is implemented by assembling a plurality of front and rear substrates, providing an upper glass and a lower glass on the respective outer surfaces of the front and rear substrates, and sealing them to each other, thereby preventing an image from being sectioned on a display part. In addition, the upper glass and the lower glass enhance the durability of the plasma display panel.

While this invention has been particularly shown and described with reference to a preferred embodiment thereof, it will be understood by those skilled in the art that various changes in form and details may be made therein without departing from the spirit and scope of the invention as defined by the appended claims.

What is claimed is:

1. A method for fabricating a plasma display panel, comprising:

preparing a front substrate assembly from a plurality of front substrates for forming a display part for displaying an image and a rear substrate assembly from a plurality of rear substrates to be sealed to the front substrate assembly;

coating only an edge of the front and rear substrate assemblies with a first frit glass;

preparing an upper glass to be mounted on the top of the front substrate assembly and a lower glass to be mounted on the rear substrate assembly;

coating only an edge of the upper and lower glasses with a second frit glass;

positioning the front and rear substrate assemblies between the upper and lower glasses and coating an outer side edge of the front and rear substrate assemblies with a third frit glass;

sealing the front substrate assembly to the rear substrate assembly and sealing the upper glass to the front substrate assembly and the lower glass to the rear substrate assembly;

evacuating at high temperature to remove gases from between the front and rear substrate assemblies; and injecting a discharge gas between the front and rear substrate assemblies.

2. The method of claim 1, wherein, in coating only the edge of the front and rear substrate assemblies with the first frit glass, a display part on an inner side of the front and rear substrate assemblies is not coated with the first frit glass, so only an outer edge of the front and rear substrate assemblies is coated with the first frit glass.

3. The method of claim 1, wherein, for the evacuating at high temperature, a second evacuation hole is formed in the lower glass and having a central axis aligned with a first evacuation hole in the rear substrate, wherein gases are evacuated via the first and second evacuation holes.

* * * * *